United States Patent [19]

Cournoyer

[11] 4,158,375

[45] Jun. 19, 1979

[54] SCREWDRIVER

[76] Inventor: Roger Cournoyer, 17200 Libby Rd., Maple Heights, Ohio 44137

[21] Appl. No.: 878,688

[22] Filed: Feb. 17, 1978

[51] Int. Cl.[2] ..... B25B 15/00

[52] U.S. Cl. ..... 145/50 C; 145/50 B

[58] Field of Search ..... 145/50 C, 50 B

[56] References Cited

U.S. PATENT DOCUMENTS

| | | | |
|---|---|---|---|
| D. 180,643 | 7/1957 | Fitch | 145/50 C |
| 366,439 | 7/1887 | Troy | 145/50 C |
| 1,239,131 | 9/1917 | Shay | 145/50 C |
| 1,728,141 | 9/1929 | Tomelick | 145/50 C |
| 1,780,785 | 11/1930 | Jansson et al. | 145/50 C |
| 2,933,963 | 4/1960 | Blasdell | 145/50 C |

FOREIGN PATENT DOCUMENTS

| | | | |
|---|---|---|---|
| 312463 | 5/1919 | Fed. Rep. of Germany | 145/50 C |

*Primary Examiner*—Robert Louis Spruill
*Assistant Examiner*—J. T. Zatarga

[57] ABSTRACT

A screwdriver comprising a shank, a conventional screw driving head projecting from one end of the shank and in alignment therewith and characterized by an auxiliary screw driving head including a pair of auxiliary screw driving bits projecting from opposite sides respectively relative to the shank and angularly arranged relative to each other whereby a screw with a limited overhead space may be screwed by alternative engagement of the auxiliary screw driving bits with the head of the screw and progressive complementary rotation of the auxiliary bits. The latter are angularly arranged at different angles relative to the shank each as seen in front view. Thus for slotted head screw the auxiliary ribs are angularly offset one relative to the other by an angle of preferably 90° between them as seen in front view to complementarily produce a rotation of 180°. For an allen screw or phillips screw the auxiliary bits are similarly offset by preferably 45° to complementarily produce a rotation of 90°.

2 Claims, 20 Drawing Figures

SCREWDRIVER

The present invention relates to a screwdriver of the type including a shank and a conventional screw driving head at one end of the shank to function as a conventional screwdriver with endwise engagement of the end of a screw. It must be noted that the conventional screw driving head may be one with any appropriate screw driving bit to function on either an allen, phillips, or slotted head screw.

It is often necessary to screw or unscrew such screws in tight places having limited overhead and lateral room around the screws. Such situation may for example be encountered in wall outlet boxes.

DESCRIPTION OF THE PRIOR ART

There is known the conventional and most common screwdriver wherein the screw driving head or bits project from one end of the shank and in alignment therewith. Such screwdriver requires an overhead space above each screw having at least the length of the screwdriver. Such screwdriver can not therefore be used in the above mentioned tight spaces. There are known other screwdrivers whose shank is disposed at right angles to the screw axis during the operative action in the screw (see for instance (U.S. Pat. Nos. 2,141,072 and 2,750,974). The above mentioned other screwdrivers include a single screw driving head or rib which must be rotated at least 180° relative to the screw axis to produce screwing or unscrewing of a slotted head screw. The resulting 180° displacement of the shank of such other screwdrivers require sufficient lateral room to produce such rotation. Therefore, such other screwdrivers are not suitable for use when only about 90° rotation or less is allowable in a limiting overhead space.

OBJECTS OF THE INVENTION

It is a general object of the present invention to provide a screwdriver of the above type which is adapted to operate on screws located in tight spaces having limited overhead and lateral room around the screws.

It is another general object of the present invention to provide a screwdriver of the above type which is adapted to operate on screws located in tight spaces and which is suitable for use when as little as only 90° rotation is allowable for a slotted head screw and as little as only 45° rotation is allowable for an allen screw or a phillips screw.

It is a further general object of the present invention to provide a screwdriver of the above type, which is adapted to operate on screws located in tight spaces having limited overhead and lateral room around the screws, and wherein the rotation of the screw is produced by alternative engagement of two screw driving bits with the head of the screw and progressive complementary rotation of these bits one after the other.

It is another object of the present invention to provide a screwdriver of the above type with laterally projecting auxiliary screw driving bits which are readily addable thereto.

SUMMARY OF THE INVENTION

The screwdriver of the invention comprises a shank, a main screw driving head at one end of the shank and including a main screw driving bit operatively projecting endwise thereof, and an auxiliary screw driving head including auxiliary screw driving bits transversely projecting from opposite sides respectively relative to said shank and being angularly arranged at different angles relative to the shank and as seen each in a front view thereof or as simultaneously seen in a development view taken circumferentially around the shank whereby a screw with limiting overhead space may be screwed by alternative engagement of said auxiliary screw driving bits therewith and progressive complementary rotation by the latter one after the other; the different angles are offset one relative to the other by an angle equal to half the angle separating two circumferentially consecutive radial prominences of the auxiliary screw driving bits, as both seen in front view; preferably, the auxiliary screw driving head is separately formed and includes a central aperture and the shank operatively extends into this central aperture.

DETAILED DESCRIPTION OF THE PREFERRED EMBODIMENTS

Figure 1:
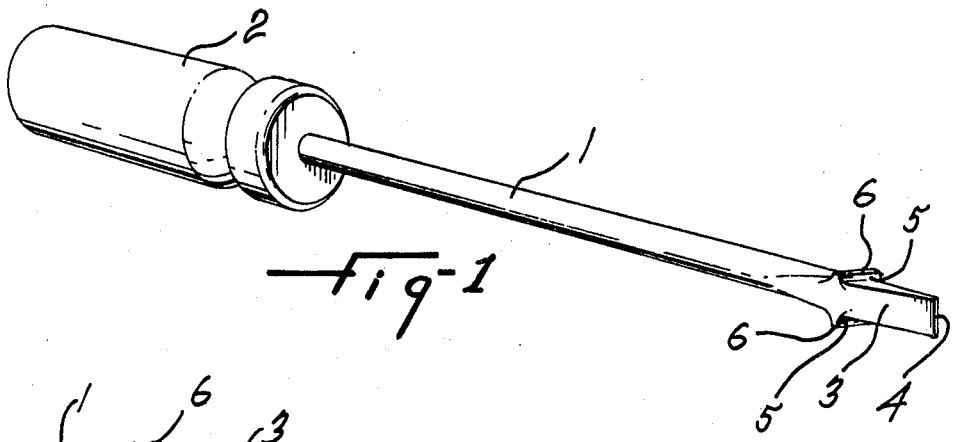
FIG. 1 is a perspective view of a screwdriver according to one embodiment of the invention.
Figure 4:
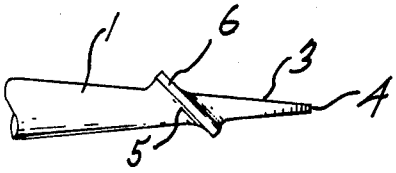
FIG. 4 is a front view of one auxiliary screw driving bit as seen at 90° with respect to FIG. 2.
Figure 2:
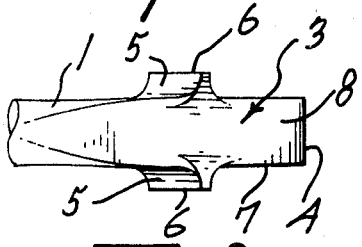
FIG. 2 is an elevation view looking at one side of the main screw driving head and showing the auxiliary screw driving bits of the screwdriver of FIG. 1.
Figure 3:
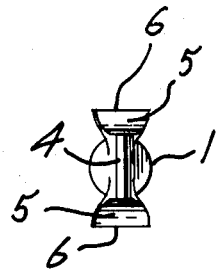
FIG. 3 is an end view as seen from the right in FIG. 2.
Figure 5:
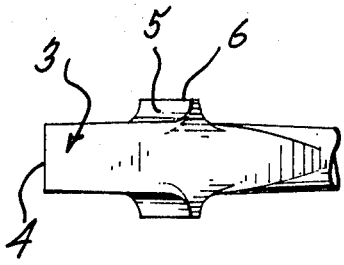
FIG. 5 is an elevation view as seen from the opposite side compared to FIG. 2.
Figure 8:
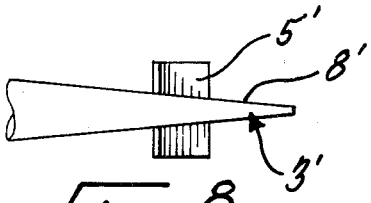
FIGS. 6, 7, 8 and 9 show an auxiliary and a main screw driving heads in accordance with a second embodiment of the invention shown in the positions corresponding respectively to FIGS. 2, 3, 4 and 5.
Figure 6:
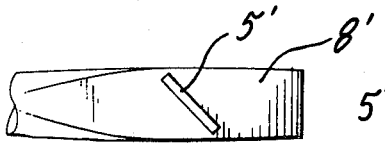
Figure 7:
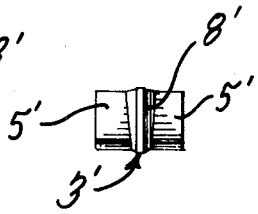
Figure 9:
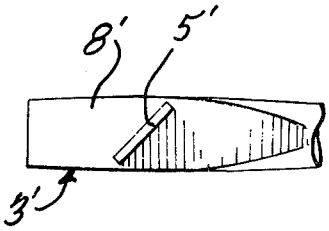

The screwdriver in accordance with the first embodiment, illustrated in FIGS. 1 to 5 inclusive includes the usual shank 1 and handle 2 secured at one end of the shank and which may be of any size, shape and construction. The other end of the shank is formed with a flat and tapering screw driving head 3, projecting endwise from the shank and forming a screw driving bit having, as in usual screwdriver construction, a transverse straight free edge 4, of uniform thickness throughout, adapted to engage the single slot of a slotted screw head with the shank extending coaxial with the screw axis for normal screwing or unscrewing of the screw.

In accordance with the characteristics of the present invention an auxiliary screw driving head is provided including auxiliary screw driving bits consisting of a pair of flat ribs 5 integral with the head 3 and protruding from opposite sides of the head 3 near the free edge 4 but inwardly thereof. Each of the ribs 5 forms a straight, transverse free edge 6 of uniform thickness throughout and having the same thickness as free edge 4 of the main screw driving bit. The two ribs 5 extend on a common plane, which is inclined to the longitudinal axis of shank 1, preferably making a 45° angle therewith. The center of edges 6 are located on a straight line perpendicular to, and intersecting the longitudinal axis of the shank. If one looks at a front view of each of the two sides having a rib 5, it will be seen that these ribs 5 are arranged at different angles relative to the shank. These front views may for instance be obtained and simultaneously seen in a development view taken circumferentially around the shank.

The ribs 5 can be forged in one piece with the shank 1 and head 3, or can be welded to the head 3. In the embodiment of FIGS. 1 to 5, the ribs 5 extend from the narrow opposite edge faces 7 of the head 3 and, therefore, protrude equally from the respective main flat faces 8 of the head.

In the embodiment of FIGS. 6 to 9, the ribs 5' extend directly from the main flat faces 8' of the screwdriver head 3'.

The second embodiment of FIGS. 6 to 9 works as efficiently as the first embodiment, but the ribs 5' constitute an obstruction for a good sighting of the screw head when the screwdriver is used in normal maner, this not being the case with the first embodiment in which an obstruction free sight of the screw head slot can be had along the flat faces 7.

The embodiment illustrated in FIGS. 13 to 18 inclusive uses a conventional screwdriver including a conventional shank 1, handle 2, and main screw driving head having the flat faces 3 and rib 4. In this embodiment, the auxiliary screw driving head 9 is distinctively made as a separate piece which is inserted on the shank 1 before fixing the handle 2 to the shank. The screw driving head 9 may be fixed on the shank 1 adjacent the main screw driving head or can be arranged slidable on the shank 1 between said last named position and an inoperative position adjacent handle 2.

The auxiliary screw driving head 9 includes a pair of screw driving bits in the form of ribs 10 which transversely project endwise from opposite sides respectively of this auxiliary head relative to the shank. The ribs 10 extend in the same common plane intersecting the shank preferably at 45° in the afore mentioned manner defined in relation to the ribs 5, 5'. Thus, the ribs 10 make an angle of preferably 45° relative to the shank 1.

Figures 13, 14, 15, 16, 17, 18, 19, 20:
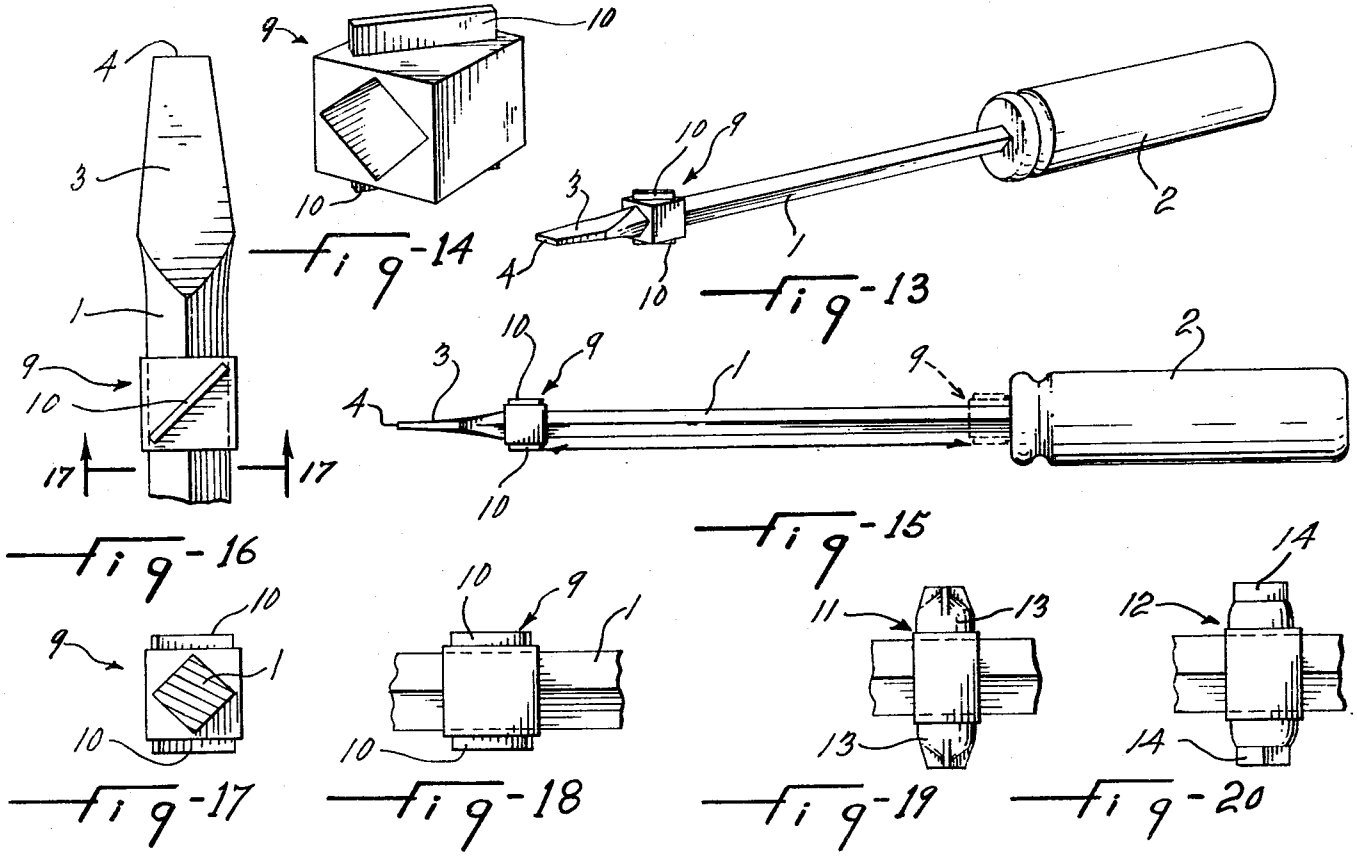
FIG. 13 is a perspective view of a screwdriver according to a third embodiment of the present invention.
FIG. 14 is a perspective of a separate auxiliary screw driving head forming part of the embodiment of FIG. 13.
FIG. 15 is a side view of the screwdriver of the third embodiment.
FIG. 16 is a front view of an auxiliary screw driving bit and also showing the associated main screw driving head.
FIG. 17 is a cross-sectional view as seen along line 17—17 in FIG. 16.
FIG. 18 is a side view as seen from the left in FIG. 17.
FIGS. 19 and 20 are side views, as in FIG. 18 but of two other embodiments of the present invention.

The same principle of the present invention is also applicable when any of the main screw driving head or the auxiliary screw driving head is made with bits to drive allen screws or phillips screw rather than slotted head screws. For instance as shown in FIGS. 19 and 20, there are shown two embodiments of the invention in which the auxiliary screw driving heads 11 and 12 respectively are of the same type as the auxiliary head 9 except that they are formed with screw driving bits 13 and 14 to drive phillips screws and allen screws respectively. Any of the heads 11 and 12 may be combined with any type of main screw driving head; for slotted head screws, allen screws, or phillips screws.

In the case of the screw driving bits 13 and 14, there are four sides or prominences circumferentially of the bit, rather than only two as in the case of the ribs 5, 5' and 10. As a result, only a 45° rotation of the shank is required to achieve the required progressive complementary rotation of 90° or ¼ turn by the two bits 13 or 14, one after the other. To achieve this, the bits 13 and 14 must be offset by 45°, as shown in FIGS. 19 and 20 such that one bit will rotate the screw by 45° and the opposite bit will be at the required angle to add another 45° rotation and thus achieve the required 90° rotation which allows the first bit to again become operative to continue the progressive rotation of the screw.

For any pair of auxiliary driving bits, it may be said that the different angles formed by each auxiliary bit relative to the shank 1 must be offset one relative to the other by an angle preferably equal to half the angle separating two circumferentially consecutive radial prominences of the corresponding auxiliary bit. This offset angle must be at least less than this angle between two prominences but if different than half there will be required more than a 90° rotation of the shank for the ribs 5, 5' and 10° or 45° rotation for the bits 13 and 14.

Figure 10:
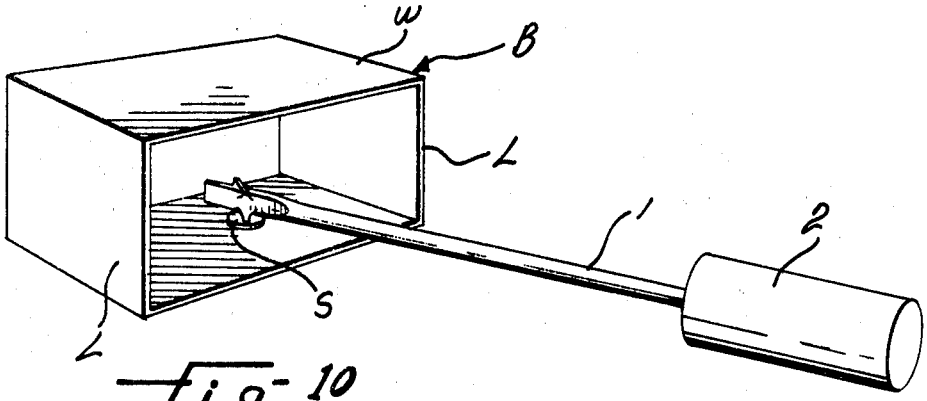
FIG. 10 is a perspective view of the screwdriver in accordance with the first embodiment showing how it can be used in a restricted space.

The screwdriver in accordance with either embodiment of the invention can be used in normal manner with the shank 1 coaxial with the screw axis and with the main driving bit such as the free edge 4 engaging endwise the head of the screw. In addition, the screwdriver in accordance with any embodiment can be used in the manner shown in FIGS. 10 to 12. For instance, in a box, such as an electrical outlet box B, wherein there is limited overhead and lateral space around the screw head 5, such as when limited, for instance, a top wall W of the box, and when also limited laterally by the lateral walls L of the box.

Figure 11:
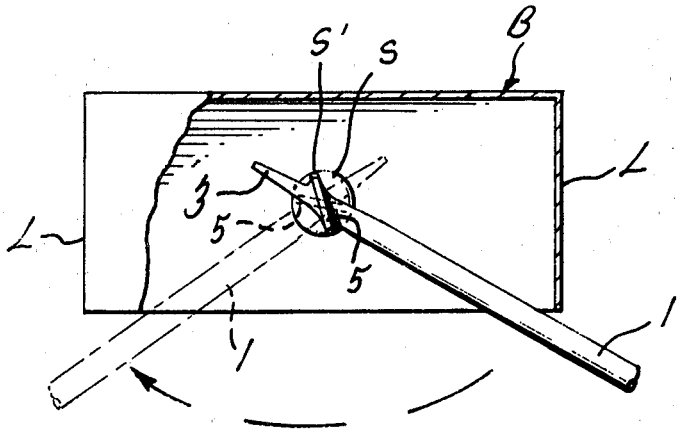
FIGS. 11 and 12 are plan sections of the box of FIG. 10 and showing the consecutive steps to be performed with a screwdriver during screwing of a screw within a restricted space.
Figure 12:
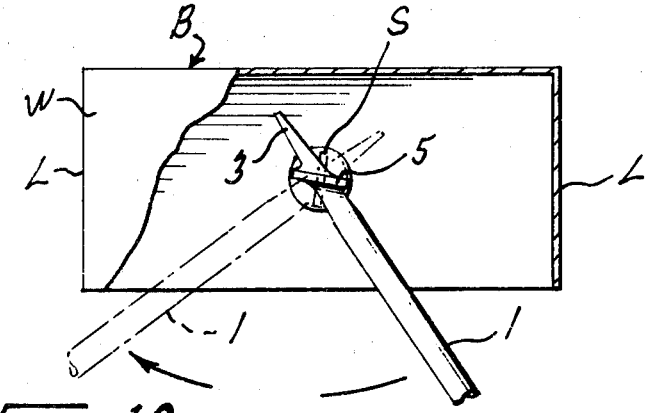

Supposing the screw head slot 5' of the screw 5 to be screwed is initially orientated, as shown in FIG. 11, then one rib 5 is inserted into the slot 5', in which case the shank 1 is orientated as shown in full line; after clockwise rotation of the shank has been effected, for instance, to the position shown in dot-and-dash line in FIG. 11, the shank is rotated about its longitudinal axis through half a turn, which brings the opposite rib 5 opposite the slot provided the shank is brought back 90 degrees, as shown in full line in FIG. 12, so as to align this next rib with the slot and to insert the next rib in the slot.

By turning the shank again through 90 degrees, to the dot-and-dash line position of FIG. 12, the screw is again rotated through 90 degrees and this cycle can be repeated as necessary, whereby it is clearly shown that the side walls of the box will not obstruct rotation of the screwdriver as long as the accessible included angle to the screw axis is at least 90 degrees.

It will be noted that, when rotating the shank half a turn about its longitudinal axis, the opposite rib 5 is brought into a position which is a 90 degrees to the position previously occupied by the other rib.

What I claim is:

1. A screwdriver comprising a straight shank of non-circular uniform cross-section, a handle secured to one end of said shank, a main screw driving head integrally formed with the other end of said shank and including a main bit extending co-axially with and outwardly from said shank and an auxiliary screwdriving head comprising a block having a through bore of a cross-sectional shape complementary to the cross-sectional shape of said shank, said auxiliary head slidable along said shank between an operative position adjacent said main head and an inoperative position adjacent said handle, said main head forming an enlargement at said other end of said shank to limit slidable movement of said auxiliary head along said shank, and a pair of auxiliary screwdriving bits integrally formed with said block and laterally projecting from opposite sides of said block and angularly disposed and arranged in parallelism relative to the longitudinal extent of said shank.

2. A screwdriver as defined in claim 1, wherein each bit forms a straight transverse free edge of uniform thickness, and the free edge of each auxiliary bit makes a 45-degree angle with the longitudinal extent of said shank.

* * * * *